United States Patent [19]

Pietryka

[11] 4,086,955

[45] May 2, 1978

[54] HEAD FOR A STARTER BAR USED IN THE CONTINUOUS CASTING OF MOLTEN METAL

[75] Inventor: Joseph Pietryka, Paris, France

[73] Assignee: Fives-Cail Babcock, Paris, France

[21] Appl. No.: 750,617

[22] Filed: Dec. 15, 1976

[30] Foreign Application Priority Data

Dec. 18, 1975 France ..... 75 38791

[51] Int. Cl.[2] ..... B22D 11/08

[52] U.S. Cl. ..... 164/446

[58] Field of Search ..... 164/274

[56] References Cited

U.S. PATENT DOCUMENTS

| | | | |
|---|---|---|---|
| 3,593,776 | 7/1971 | Williamson | 164/274 |
| 3,717,198 | 2/1973 | Marti | 164/274 |
| 3,921,706 | 11/1975 | Wiesinger | 164/274 |

FOREIGN PATENT DOCUMENTS

| | | | |
|---|---|---|---|
| 1,508,896 | 11/1969 | Germany | 164/274 |

*Primary Examiner*—Francis S. Husar
*Assistant Examiner*—John S. Brown
*Attorney, Agent, or Firm*—Kurt Kelman

[57] ABSTRACT

A dummy or starter bar head used in the continuous casting of molten metal has an elongated cavity along its upper small face whose cross section increases inwardly from the small face. This cavity is formed partly in the head and partly in an insert removably mounted on the head, the plane of separation between the portion of the cavity defined by the head and that defined by the insert being so disposed that cast solidified metal formed in the cavity may be lifted out of the portion of the cavity after the insert has been removed.

5 Claims, 3 Drawing Figures

HEAD FOR A STARTER BAR USED IN THE CONTINUOUS CASTING OF MOLTEN METAL

The present invention relates to the continuous casting of molten metal, such as steel, and more particularly to the head of a starter bar used at the start of a casting operation. Continuous metal casting is described, for example, in The Making, Shaping and Treating of Steel, published by United States Steel Company, Pittsburgh, Pa., whose chapter on Continuous Casting of Blooms, Slabs and Billets is incorporated herein by reference with respect to the conventional structure of molds and starter bars used in continuous casting operation.

Heads of dummy or starter bars used in the continuous casting of metals have means for anchoring the cast metal, after it has solidified in the mold, to the head so as to assure interconnection of the cast ingot and the starter bar head as the same is moved out of the mold.

To assure this interconnection, it has been proposed to provide a necked cavity in the upper small face of the head. When the molten metal is poured from the tundish into the mold, it flows into this cavity and, after solidification, is firmly anchored therein so that the molded ingot is affixed to the head of the starter bar and may be moved out of the mold by the starter bar. Since the solidified metal remains part of the head and cannot be removed therefrom, the head cannot be re-used.

It has also been proposed to constitute the starter bar head of two pivoted jaws which, when closed, form the upper face of the head with a slot for receiving the molten metal. This structure is, however, complicated and its operation is not dependable under the very harsh operating conditions of high temperatures and exposure to cooling water jets under which the pivoting of the jaws may be impeded.

It is the primary object of the invention to provide a head for a starter or dummy bar which is of simple structure while permitting repeated utilization.

The above and other objects are accomplished in accordance with the present invention with a head having two large faces and an upper small face extending therebetween and wherein one of the large faces defines a chamber reaching to the upper small face. An insert of complementary shape is removably mounted in the chamber and the head and insert together and supplementally define a transverse elongated cavity opening into the small face of the head. The cavity has a cross section at the small face smaller than the cross section of the remainder of the cavity, and the plane of separation between the portion of the cavity defined by the head and that defined by the insert is so disposed that cast solidified metal formed in the cavity may be lifted out of the portion of the cavity in the head after the insert has been removed.

The above and other objects, advantages and features of the present invention will become more apparent from the following detailed description of a now preferred embodiment thereof, taken in conjunction with the accompanying drawing wherein FIG. 1 is a side elevational view of the head of a dummy or starter bar according to this invention;

Figure 1:
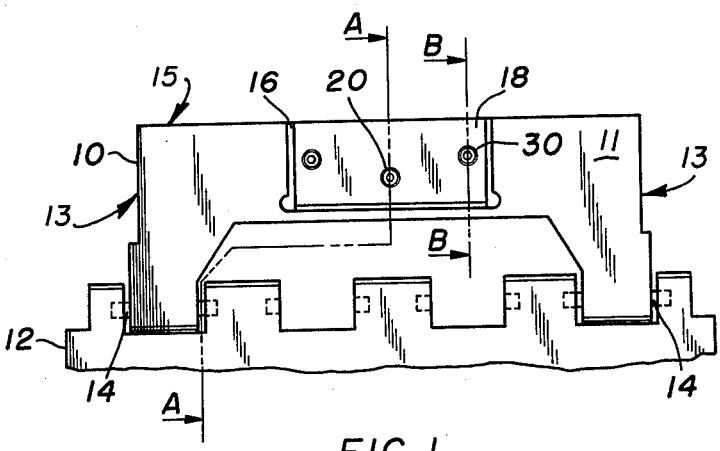

Referring now to the drawing, the illustrated head 10 of a dummy or starter bar is used for casting slabs, i.e. ingots of rectangular cross section. Head 10 is hinged to an end of dummy bar 12 by pivot pins 14.

Figure 2:
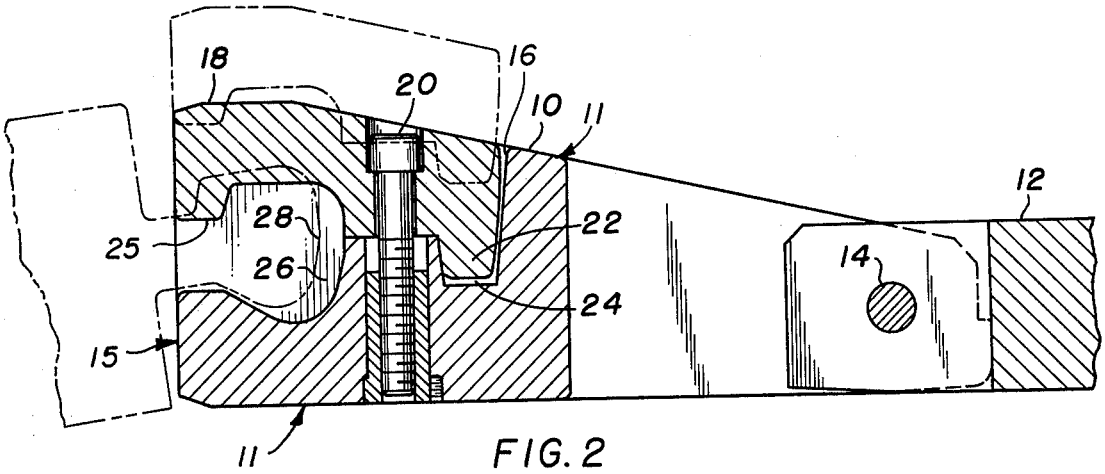
FIG. 2 is a sectional view along line A—A of FIG. 1.
Figure 3:
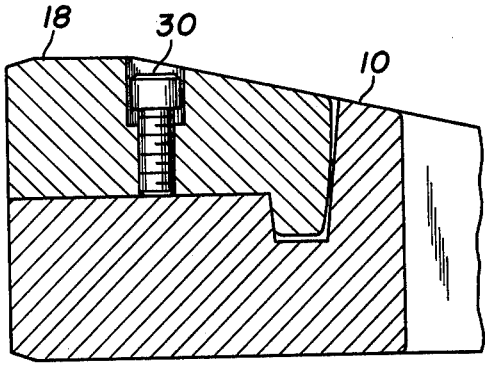
FIG. 3 is a section along line B—B of FIG. 1.

Head 10 of the dummy or starter bar 12 has two large faces 11 and two small faces 13, one of the large faces of the head defining rectangular chamber 16 which reaches to the upper face 15 of head 10 which extends between faces 11, as clearly shown in FIGS. 1 and 2. Insert 18 of a shape complementary to that of chamber 16 and fitting thereinto is affixed to head 10 by bolt 20. This insert has a projecting rim 22 received in corresponding groove 24 in the bottom of chamber 16. This rim of insert 18 serves to resist forces parallel to the large side faces of head 10 to which insert 18 is subjected at the start of casting.

As shown in FIG. 2, transverse elongated cavity 26 is defined partially in head 10 and partially in insert 18. This cavity opens into the upper face 15 of the head through slot 25 which extends parallel to the large faces of the head.

At the beginning of casting, when the head of the starter bar closes off the bottom of the mold, the molten metal poured into the mold from a tundish flows into cavity 26 and, as it solidifies therein, it forms appendix 28 which connects the head of the starter bar to the slab formed in the mold. When the head of the starter bar reaches the point of disengagement, the slab is cut off several centimeters from the head and the starter bar with its head is moved to a point of preparation where insert 18 is removed from head 10 by unscrewing bolt 20, and appendix 28 with the remaining cut-off end of the slab is simply lifted from cavity 26, as shown in chain-dotted lines in FIG. 2.

Screws 30 are threadedly mounted in threaded bores in insert 18 and constitute jacks enabling the insert to be moved from head 20, the inner ends of screws 30 engaging the bottom of chamber 16 in case liquid metal has infiltrated between the insert and the head and has welded them to each other. Turning of screws 30 will force the insert to be disengaged from the head.

I claim:

1. A head for a starter bar used in the continuous casting of liquid metal, the head having two large faces and an upper face extending therebetween, one of the large faces defining a chamber reaching to the upper face, an insert of complementary shape removably mounted in the chamber, and the head and insert together defining a transverse elongated cavity opening only into the upper face of the head, the cavity being adapted to hold molten metal poured thereinto through the opening and having a cross section at the upper face smaller than the cross section of the remainder of the cavity, and the plane of separation between the portion of the cavity defined by the head and that defined by the insert being so disposed that cast solidified metal formed in the cavity may be lifted out of the portion of the cavity in the head after the insert has been removed.

2. The starter bar head of claim 1, further comprising bolt means extending substantially parallel to the upper face between the head and the insert, and removably mounting the insert on the head.

3. The starter bar head of claim 1, wherein at least the portion of the cavity defined by the head is bounded by rounded surfaces.

4. The starter bar head of claim 1, wherein the cavity extends in the direction of the largest dimension of the head and opens into the upper face through a slot substantially parallel to this direction.

5. A head for a starter bar used in the continuous casting of liquid metal, the head having two large faces and an upper face extending therebetween, one of the large faces defining a chamber reaching to the upper face, an insert of complementary shape removably mounted in the chamber, and the head and insert together defining a transverse elongated cavity opening only into the upper face of the head, the cavity being adapted to hold molten metal poured thereinto through the opening and having a cross section at the upper face smaller than the cross section of the remainder of the cavity, and the plane of separation between the portion of the cavity defined by the head and that defined by the insert being so disposed that cast solidified metal formed in the cavity may be lifted out of the portion of the cavity in the head after the insert has been removed, and further comprising jacking screws mounted in threaded bores in the insert and extending to the bottom of the chamber for enabling the insert to be moved from the head by turning of the screws.

* * * * *